US012607353B2

(12) United States Patent
Kakizaki

(10) Patent No.: US 12,607,353 B2
(45) Date of Patent: Apr. 21, 2026

(54) COMBUSTION DEVICE AND WATER HEATER

(71) Applicant: PALOMA CO., LTD., Nagoya (JP)

(72) Inventor: Yusuke Kakizaki, Nagoya (JP)

(73) Assignee: PALOMA CO., LTD, Nagoya (JP)

( * ) Notice: Subject to any disclaimer, the term of this patent is extended or adjusted under 35 U.S.C. 154(b) by 401 days.

(21) Appl. No.: 18/515,971

(22) Filed: Nov. 21, 2023

(65) Prior Publication Data

US 2024/0183531 A1 Jun. 6, 2024

(30) Foreign Application Priority Data

Dec. 1, 2022 (JP) ..... 2022-193058

(51) Int. Cl.

| | |
|---|---|
| ***F23K 5/00*** | (2006.01) |
| ***F23D 23/00*** | (2006.01) |
| *F24H 1/10* | (2022.01) |

(52) U.S. Cl.

CPC ..... *F23K 5/005* (2013.01); *F23D 23/00* (2013.01); *F23K 2400/201* (2020.05); *F24H 1/107* (2013.01)

(58) Field of Classification Search

CPC ..... F23D 5/005; F23D 5/007; F23D 23/00
See application file for complete search history.

(56) References Cited

U.S. PATENT DOCUMENTS

2021/0071907 A1* 3/2021 Park ..... F23D 14/045

FOREIGN PATENT DOCUMENTS

| | | | |
|---|---|---|---|
| CN | 215929552 U | * | 3/2022 |
| JP | 2019027658 A | * | 2/2019 |
| JP | 2021188771 A | * | 12/2021 |
| JP | 2021188772 A | * | 12/2021 |
| JP | 2022076326 A | * | 5/2022 |
| JP | 2022089030 A | * | 6/2022 |

* cited by examiner

*Primary Examiner* — Gregory A Wilson
(74) *Attorney, Agent, or Firm* — Oliff PLC

(57) ABSTRACT

A combustion device includes a solenoid valve configured to open and close an inflow port and an additional solenoid valve configured to open and close a communication port selectively mountable at an upstream end of a distribution flow passage with a small number of nozzles. When the additional solenoid valve is mounted, a state of supplying a fuel gas to only a distribution flow passage with a large number of the nozzles by opening the solenoid valve and closing the additional solenoid valve and a state of supplying the fuel gas to two distribution flow passages by opening the solenoid valve and opening the additional solenoid valve are mutually switchable. When the additional solenoid valve is not mounted, a state of supplying the fuel gas to the two distribution flow passages by opening the solenoid valve and a state of not supplying the fuel gas are mutually switchable.

6 Claims, 10 Drawing Sheets

COMBUSTION DEVICE AND WATER HEATER

CROSS REFERENCE TO RELATED APPLICATION

This application claims the benefit of Japanese Patent Application Number 2022-193058 filed on Dec. 1, 2022, the entirety of which is incorporated by reference

FIELD OF THE INVENTION

The disclosure relates to a combustion device in which the number of combustion stages is switchable by distributing and supplying a fuel gas to a plurality of burners in a water heater, and a water heater including the combustion device.

BACKGROUND OF THE INVENTION

A water heater includes a combustion device provided with burners and a heat exchanger in a housing, and heats water passing through the heat exchanger by a combustion exhaust gas of the burners combusted by igniting a mixture of a fuel gas and a combustion air, thereby causing hot water to flow out.

For the burners disposed in the combustion device, a plurality of flat-shaped burners are disposed in a thickness direction and unitized, and a gas distribution unit is disposed in an upstream side of the burner unit. The gas distribution unit includes, as disclosed in JP 2021-188771 A, an aluminum die-cast main body having a plurality of nozzles corresponding to the respective burners and a lid body made of a sheet metal assembled to a front surface of the main body. A depressed portion formed in the main body and a bulge portion provided to the lid body separately form a main flow passage at an upstream end and a plurality of branch flow passages (distribution flow passages) branched from the main flow passage. Inlets communicated with the main flow passage are formed at upstream ends of the respective branch flow passages, and the inlets can be each opened and closed by a solenoid valve.

In the combustion device, a controller performs an open/close control for each solenoid valve to select a combination of the three branch flow passages to which the fuel gas is supplied, thereby allowing an adjustment of the number of the burners to be combusted. Here, the numbers of the burners disposed on the branch flow passages are eight, two, and four from the left side, and the combustion stage can be switched in five stages of one-stage combustion (two burners) by only the branch flow passage in the center, two-stage combustion (four burners) by only the branch flow passage in the right side, three-stage combustion (six burners) by the branch flow passages in the center and the right side, four-stage combustion (ten burners) by the branch flow passages in the center and the left side, and five-stage combustion (fourteen burners) by all of the branch flow passages.

SUMMARY OF THE INVENTION

The number of combustion stages of the burners (the number of burners to be combusted) in the above-described combustion device does not require the combination of five stages depending on the country, the region, or the like, and for example, the combination of three stages of six, ten, and fourteen burners is sufficient in some cases.

However, in the above-described gas distribution unit, since the branch flow passages are formed to be each independently communicated with the main flow passage, when the number of combustion stages is changed, the gas distribution unit needs to be additionally produced, thus increasing the management and manufacturing costs.

Therefore, it is an object of the disclosure to provide a combustion device and a water heater capable of reducing management and manufacturing costs by using components of a gas distribution unit substantially in common to allow dealing with a difference of the number of combustion stages.

In order to achieve the above-described object, there is provided a combustion device according to a first configuration of the disclosure. The combustion device includes an inner case and a gas distribution unit. The inner case houses three or more burners. The gas distribution unit is assembled to the inner case. The gas distribution unit includes three or more nozzles, a main flow passage, and at least two distribution flow passages. The three or more nozzles eject a fuel gas to the respective burners. The fuel gas is introduced to the main flow passage. The at least two distribution flow passages branch the fuel gas from the main flow passage to each of groups of a plurality of the nozzles mutually different in number of the nozzles. The number of the burners to be combusted is switchable by switching whether to supply the fuel gas or not to each of the distribution flow passages. In the gas distribution unit, at an upstream end of the distribution flow passage with a large number of the nozzles, an inflow port into which the fuel gas is allowed to flow from the main flow passage is formed and a solenoid valve configured to open and close the inflow port is disposed. A connecting flow passage is formed such that the connecting flow passage communicates between a downstream side with respect to the inflow port of the distribution flow passage with the large number of the nozzles and a communication port provided at an upstream end of the distribution flow passage with a small number of the nozzles. An additional solenoid valve configured to open and close the communication port is selectively mountable at the upstream end of the distribution flow passage with the small number of the nozzles. When the additional solenoid valve is mounted, a state of supplying the fuel gas to only the distribution flow passage with the large number of the nozzles by opening the solenoid valve and closing the additional solenoid valve and a state of supplying the fuel gas to the two distribution flow passages by opening the solenoid valve and opening the additional solenoid valve are mutually switchable. When the additional solenoid valve is not mounted, a state of supplying the fuel gas to the two distribution flow passages by opening the solenoid valve and a state of not supplying the fuel gas to the two distribution flow passages by closing the solenoid valve are mutually switchable.

In another aspect of the first configuration, which is in the above configuration, a valve chamber communicated with the connecting flow passage and the communication port is formed to open at the upstream end of the distribution flow passage with the small number of the nozzles, the additional solenoid valve is mountable to the valve chamber, and when the additional solenoid valve is not mounted to the valve chamber, mounting an obstruction plate that obstructs an opening of the valve chamber allows switching between the state of supplying the fuel gas to the two distribution flow passages and the state of not supplying the fuel gas to the two distribution flow passages.

In another aspect of the first configuration, which is in the above configuration, a gas supply passage that supplies the fuel gas to the main flow passage of the gas distribution unit is provided with a main solenoid valve, and the solenoid valve serves as both a solenoid valve in a downstream side of two solenoid valves disposed in series corresponding to the distribution flow passage with the large number of the nozzles and a solenoid valve in a downstream side of two solenoid valves disposed in series corresponding to the distribution flow passage with the small number of the nozzles.

In order to achieve the above-described object, there is provided a water heater according to a second configuration of the disclosure. The water heater includes the combustion device of the first configuration and a heat exchanger through which a combustion exhaust gas of the burners of the combustion device passes. The water heater is configured to cause a hot water to flow out by a heat exchange between a water passing through the heat exchanger and the combustion exhaust gas of the burners.

According to the disclosure, by using the components other than the solenoid valve of the gas distribution unit substantially in common, the difference in number of combustion stages between multiple stages and smaller number of stages can be dealt with. Accordingly, the management and manufacturing costs can be reduced.

According to another aspect of the disclosure, in addition to the above-described effect, since the additional solenoid valve and the obstruction plate are selectively mounted to the valve chamber disposed at the upstream end of the distribution flow passage with the small number of the nozzles, the state of supplying the fuel gas to the two distribution flow passages and the state of not supplying the fuel gas to the two distribution flow passages can be mutually switched. Therefore, switching the gas distribution unit is facilitated by the replacement between the solenoid valve and the obstruction plate.

According to another aspect of the disclosure, in addition to the above-described effect, the solenoid valve serves as both a solenoid valve in a downstream side of two solenoid valves disposed in series corresponding to the distribution flow passage with the large number of the nozzles and a solenoid valve in a downstream side of two solenoid valves disposed in series corresponding to the distribution flow passage with the small number of the nozzles. Therefore, the safety standard of the water heater can be satisfied even when the solenoid valve is not mounted to the distribution flow passage with the small number of the nozzles.

DETAILED DESCRIPTION OF THE INVENTION

The following describes an embodiment of the disclosure based on the drawings.

Figure 1:
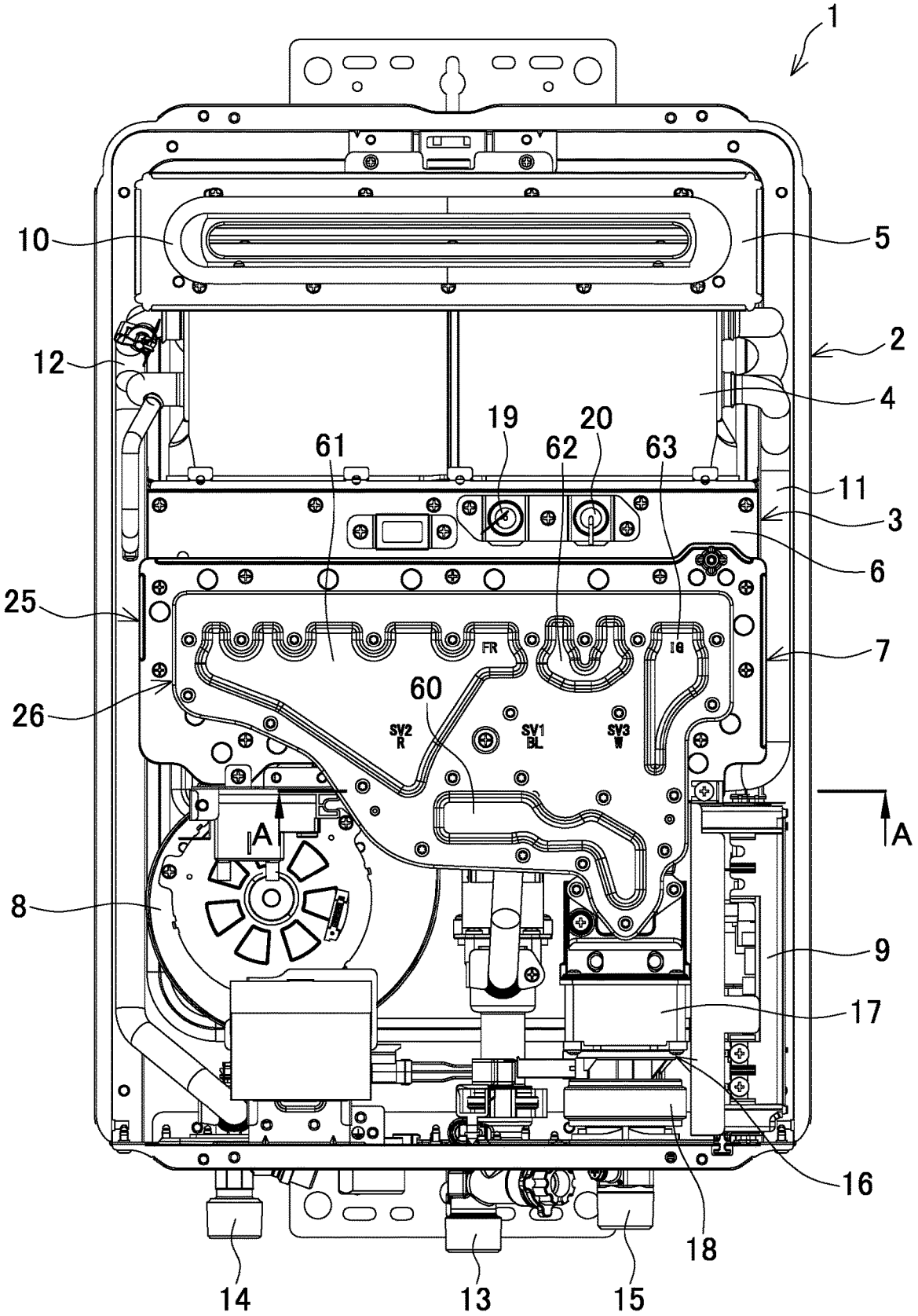
FIG. 1 is a front view of a water heater in a state where a front cover is removed.

FIG. 1 is an explanatory drawing illustrating an exemplary water heater, and illustrates a front view in a state where a front cover of a front surface is removed.

A water heater 1 includes a combustion device 3, a heat exchanger 4, and an exhaust air unit 5 in a housing 2 in a square box shape. The combustion device 3 includes an inner case 6 that houses a burner unit (not illustrated). The burner unit includes a plurality of rich-lean burners formed to be flat in a right-left direction, and the plurality of rich-lean burners are arranged in the right-left direction. To a front surface of the inner case 6, a gas distribution unit 7 is assembled, and the gas distribution unit 7 distributes and supplies a fuel gas to each of burner groups including mutually different numbers of the rich-lean burners.

To a lower surface left side of the combustion device 3, an air supply fan 8 that supplies a combustion air is assembled. In a right side inside the housing 2 at the lower side of the combustion device 3, a controller 9 including a control circuit board is disposed. The exhaust air unit 5 is provided with an exhaust cylinder 10 that is elongated in the right-left direction and penetrates the front cover to project forward.

The heat exchanger 4 is a fin tube type including a heat transfer pipe that meanderingly penetrates a plurality of fins arranged side by side in a thickness direction. A water supply pipe 11 is connected to an inlet side end portion of the heat transfer pipe, and a hot water outlet pipe 12 is connected to an outlet side end portion of the heat transfer pipe. To a lower surface of the housing 2, a water inlet 13 to which an external water pipe is connected, and a hot water outlet 14 to which an external pipe to a hot water tap is connected are provided. An upstream end of the water supply pipe 11 is connected to the water inlet 13, and a downstream end of the hot water outlet pipe 12 is connected to the hot water outlet 14.

To the lower surface of the housing 2, a gas inlet 15 to which an external gas pipe is connected is provided. The gas inlet 15 is connected to the gas distribution unit 7 inside the housing 2 via a gas proportional valve unit 16 including a proportional valve 17 and a main solenoid valve 18 in the upstream side of the proportional valve 17.

The gas distribution unit 7 is assembled to the front surface of the inner case 6 in a manner of covering an opening in the front surface lower portion of the inner case 6. To the front surface of the inner case 6 in the upper side of the gas distribution unit 7, a flame rod 19 and a discharge electrode 20 are plug-in connected.

Figure 2:
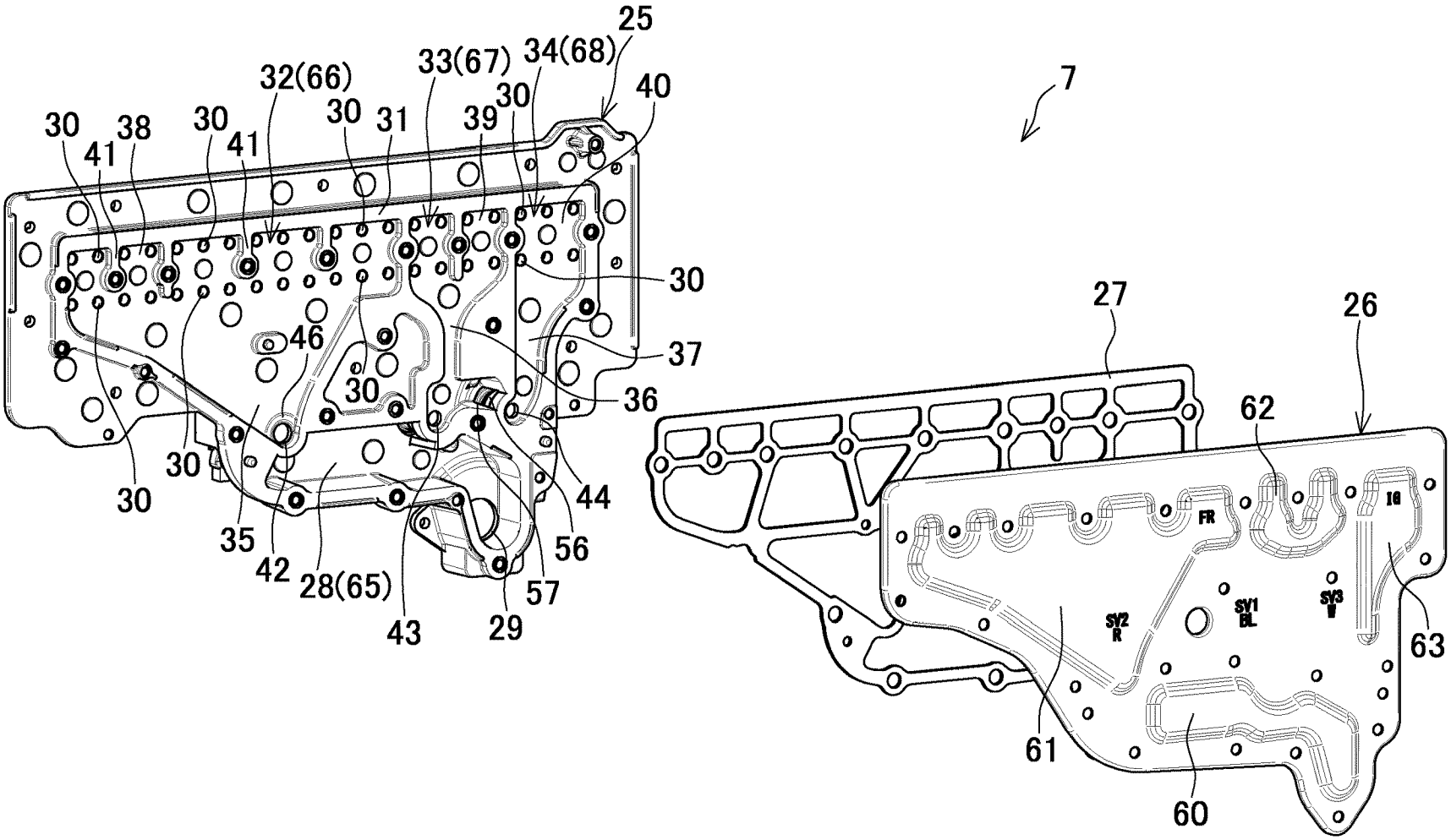
FIG. 2 is an exploded perspective view of a gas distribution unit from the front side.
Figure 3:
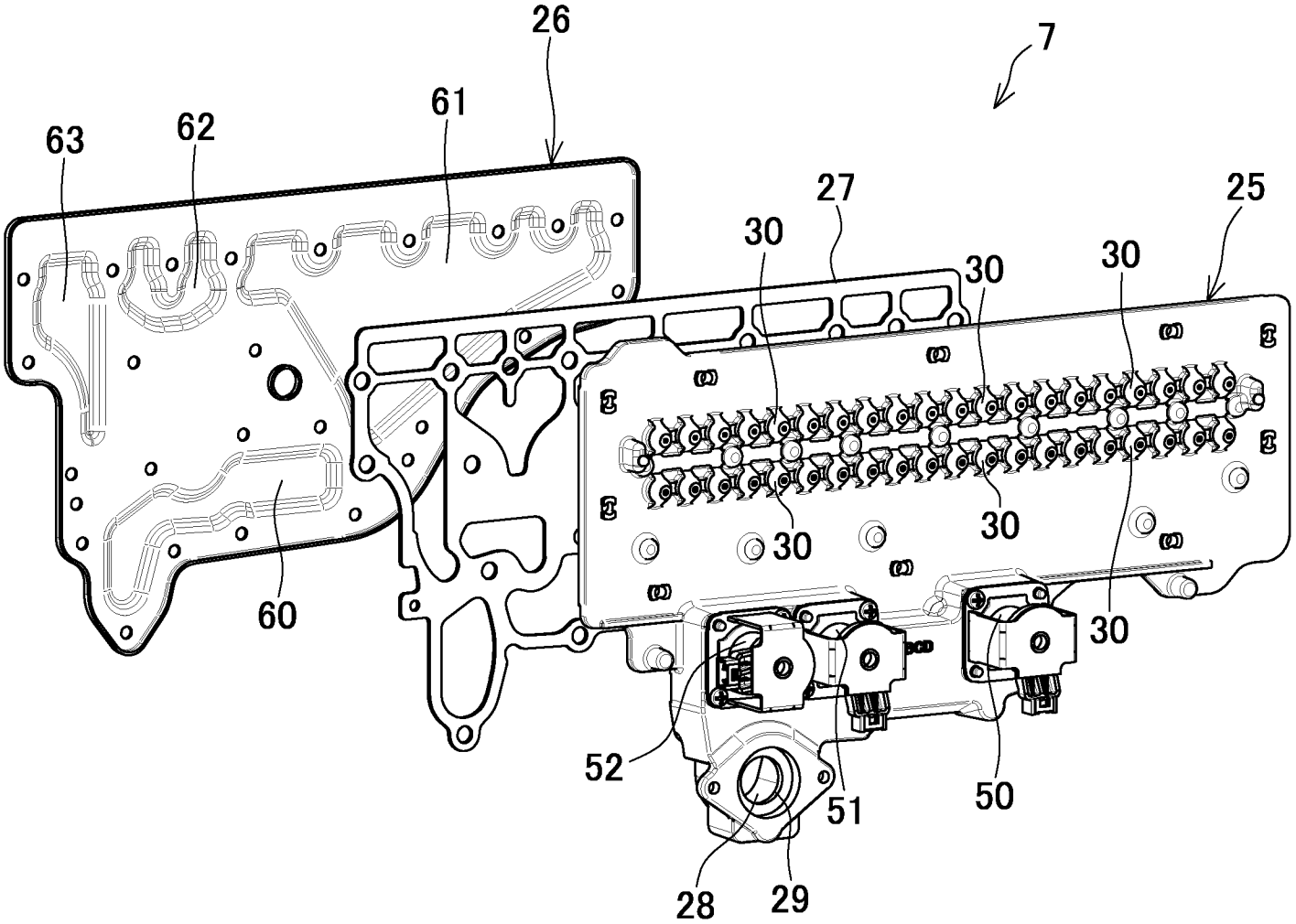
FIG. 3 is an exploded perspective view of the gas distribution unit from the rear side.

As illustrated in FIG. 2 and FIG. 3, the gas distribution unit 7 is formed in a horizontally elongated flat shape including a main body 25 in the rear side and a lid body 26 in the front side screwed to the main body 25 from the front side. A seal body 27 is interposed between the main body 25 and the lid body 26.

In the lower portion of the aluminum die-cast main body 25, a deep main depressed portion 28 projecting rearward is formed in the right-left direction. The main depressed portion 28 has a downwardly bent right end, and a gas introduction port 29 is formed to penetrate the lower end thereof. A gas outlet portion (not illustrated) provided at the upper end of the gas proportional valve unit 16 is coupled to the gas introduction port 29 from the rear side.

In the upper portion of the main body 25, twenty pairs of upper and lower nozzles 30, 30 projecting rearward are disposed side by side in the right-left direction. A first depressed portion 32, a second depressed portion 33, and a third depressed portion 34, which are each shallower than the main depressed portion 28, are formed by a ridge 31 that projects forward and is continuous in a frame shape around the nozzles 30 and between every predetermined number of nozzles 30 on the front surface of the main body 25.

Figure 4:
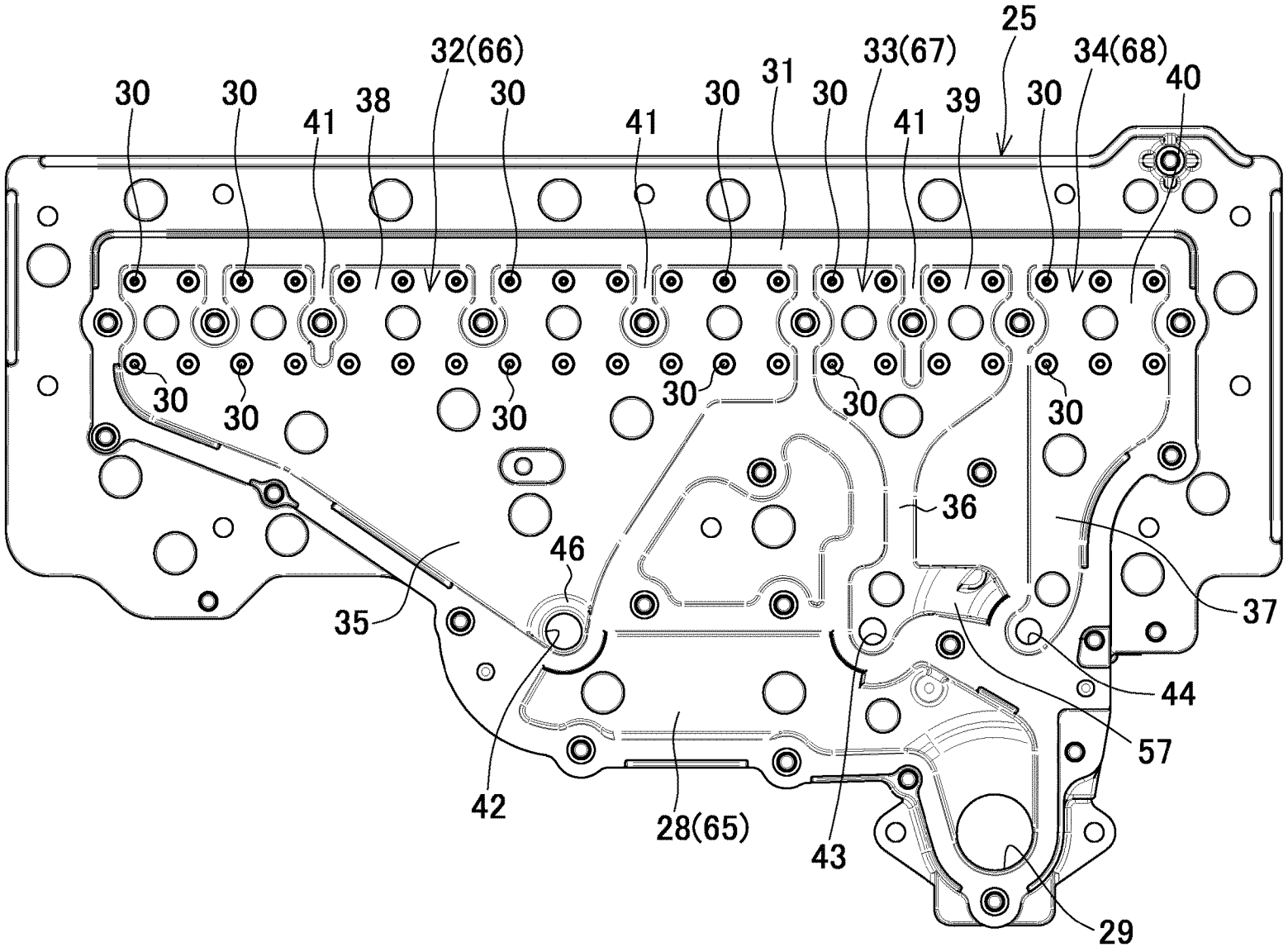
FIG. 4 is a front view of a main body.

As illustrated in FIG. 4, the first to the third depressed portions 32 to 34 include first to third introduction portions 35 to 37 and first to third distribution portions 38 to 40, respectively. The first to third introduction portions 35 to 37 extend upward from lower ends and have gradually expanding lateral widths. The first to third distribution portions 38 to 40 are communicated with upper portions of the first to the third introduction portions 35 to 37 and extend in the right-left direction. Thirteen pairs of the nozzles 30 are disposed in the first distribution portion 38, four pairs of the nozzles 30 are disposed in the second distribution portion 39, and three pairs of the nozzles 30 are disposed in the third distribution portion 40. In the first and the second distribution portions 38, 39, partition ridges 41, 41 . . . that are formed downward from the upper portion of the ridge 31 to divide the pairs of the nozzles 30 every predetermined number are provided.

Figure 5:
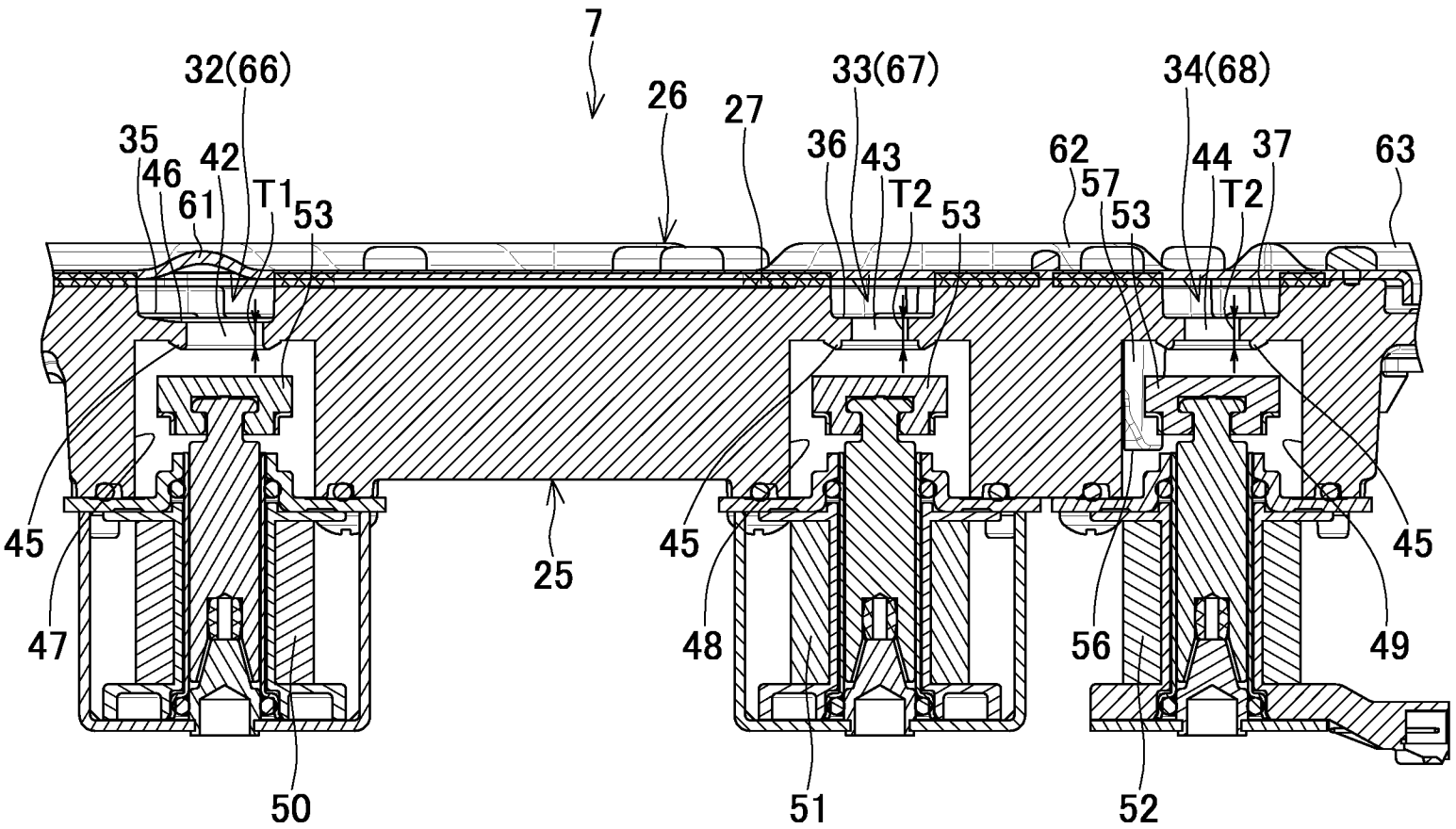
FIG. 5 is an enlarged partial cross-sectional view taken along the line A-A of FIG. 1 (illustrating only the gas distribution unit).

As illustrated in FIG. 5, first to third inlets 42 to 44 are formed to penetrate lower ends of the first to the third introduction portions 35 to 37. The first to the third inlets 42 to 44 are circular in front view, and each provided with a valve seat 45 projecting rearward in the peripheral area in the back side. The first inlet 42 has a diameter larger than diameters of the second and the third inlets 43, 44. The second inlet 43 and the third inlet 44 have the same diameter. The three valve seat 45 have the same diameter.

In the first introduction portion 35 provided with the first inlet 42, a cone-shaped tapered portion 46 having the first inlet 42 in the center as a deepest portion is formed at a part of the upper side of the first inlet 42. The tapered portion 46 provides a thickness T1 in the center axis direction of the first inlet 42 including the valve seat 45 smaller than a thickness T2 in the center axis direction of the second and the third inlets 43, 44 including the valve seats 45.

In the rear sides of the first to the third inlets 42 to 44, cylindrically-shaped first to third valve chambers 47 to 49 projecting rearward to open are formed. To the first to the third valve chambers 47 to 49, first to third solenoid valves 50 to 52 are attachably/detachably screwed from the rear side. The first to the third solenoid valves 50 to 52 include valve elements 53 abutting on the valve seats 45 to be configured to obstruct the first to the third inlets 42 to 44, respectively, and the first to the third solenoid valves 50 to 52 have the same size.

Figure 6:
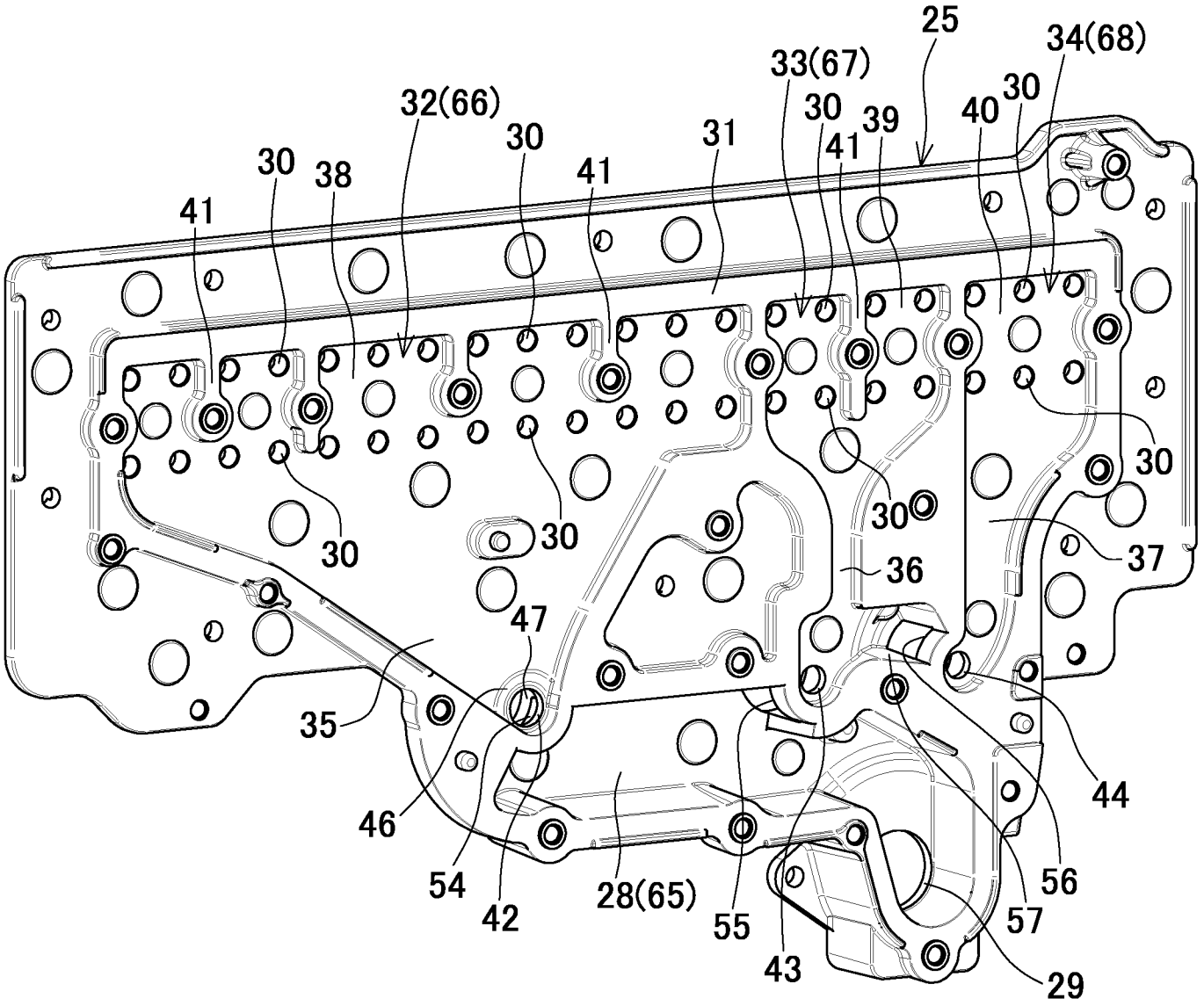
FIG. 6 is a perspective view of the main body from the front side.
Figure 7:
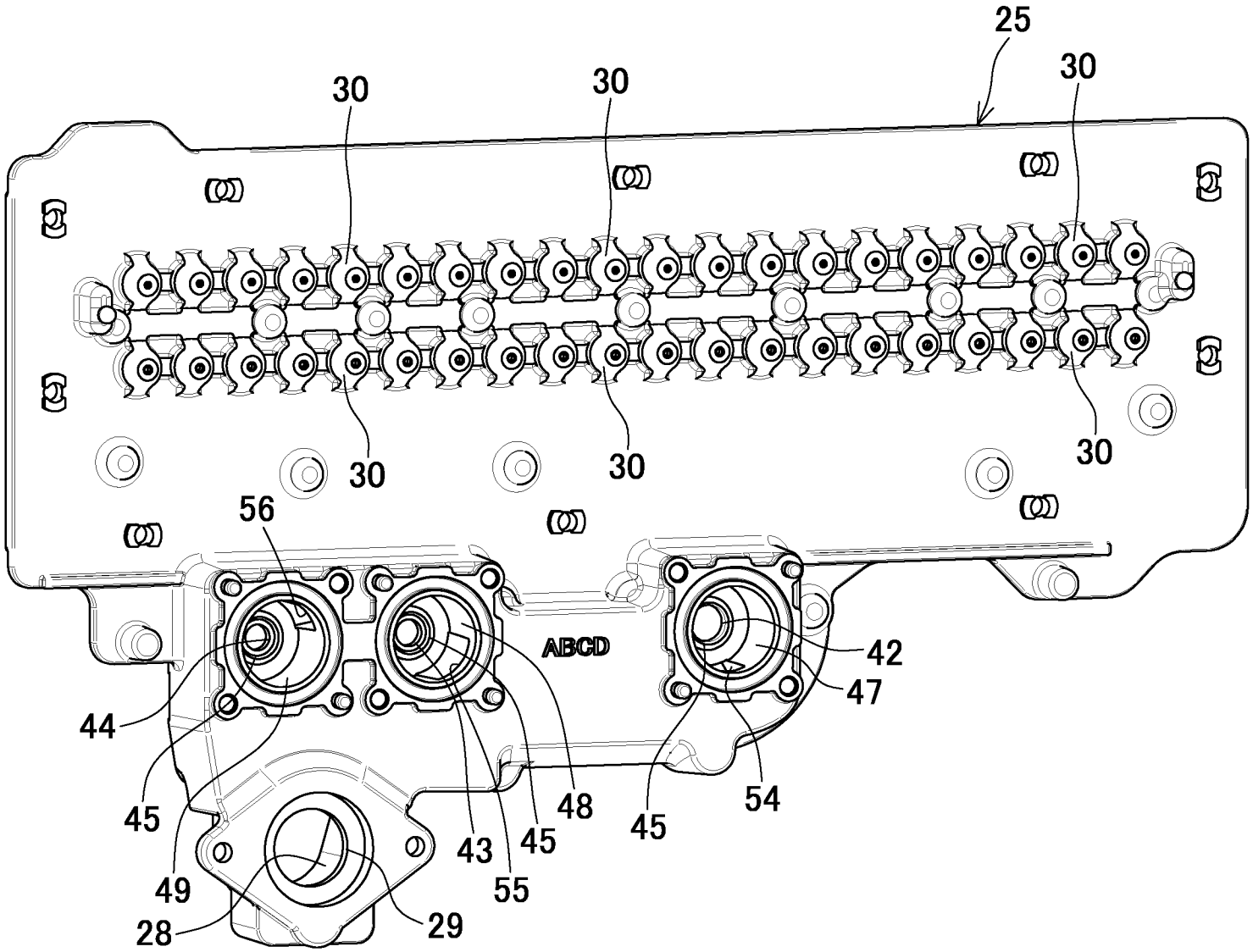
FIG. 7 is a perspective view of the main body from the rear side.

As illustrated in FIG. 6 and FIG. 7, the lower sides of the first and the second valve chambers 47, 48 are communicated with the main depressed portion 28 by first and second openings 54, 55. In the left upper side of the third valve chamber 49, a third opening 56 is formed. The third opening 56 is communicated with the upper side (downstream side) of the second inlet 43 in the second introduction portion 36 via a connecting flow passage 57 extending in the right-left direction.

The lid body 26 is made of a sheet metal, and covers a region including the main depressed portion 28 and the ridge 31 surrounding the outside of the first to the third depressed portions 32 to 34 from the front side. The lid body 26 is provided with a main bulge portion 60 positioned in the front side of the main depressed portion 28, a first bulge portion 61 positioned in the front side of the first depressed portion 32, a second bulge portion 62 positioned in the front side of the second depressed portion 33, and a third bulge portion 63 positioned in the front side of the third depressed portion 34, which are each formed to project forward.

The seal body 27 is connected to the main body 25 at a portion surrounding the main depressed portion 28 and the first to the third depressed portions 32 to 34, portions between the main depressed portion 28 and the first to the third depressed portions 32 to 34, portions between the first to the third depressed portions 32 to 34, and the like in a shape like a network, and seals between the main body 25 and the lid body 26.

Accordingly, by positioning the seal body 27 on the front surface of the main body 25 to which the first to the third solenoid valves 50 to 52 are assembled, covering it with the lid body 26, and screwing the lid body 26, a main flow passage 65 communicated with the gas introduction port 29 and the first and the second openings 54, 55 is formed by the main depressed portion 28 and the main bulge portion 60 in the gas distribution unit 7. A first distribution flow passage 66 communicated with the first inlet 42 is formed by the first depressed portion 32 and the first bulge portion 61, and a second distribution flow passage 67 communicated with the second inlet 43 is formed by the second depressed portion 33 and the second bulge portion 62. Then, a third distribution flow passage 68 communicated with the third inlet 44 is formed by the third depressed portion 34 and the third bulge portion 63. However, the third inlet 44 is communicated with the second distribution flow passage 67 in the downstream side of the second inlet 43 by the third valve chamber 49, the third opening 56, and the connecting flow passage 57 whose front surface is obstructed by the lid body 26.

For the gas distribution unit 7, by setting the main body 25 on the front surface of the inner case 6, connecting the gas proportional valve unit 16 to the gas introduction port 29, and securing the gas distribution unit 7 with screws, assembling the gas distribution unit 7 is completed.

In the water heater 1 configured as described above, when a hot water tap connected to the pipe of the hot water outlet 14 is opened, and water passes through the apparatus, the controller 9 detecting it opens the main solenoid valve 18 of the gas proportional valve unit 16, and controls the proportional valve 17 at a predetermined degree of opening of ignition.

The controller 9 causes the first to the third solenoid valves 50 to 52 of the first to the third distribution flow passages 66 to 68 to operate to open, and causes the air supply fan 8 to operate to supply the combustion air. Accordingly, the fuel gas is supplied to the main flow passage 65 of the gas distribution unit 7 via the gas proportional valve unit 16. The fuel gas flowed in the main flow passage 65 flows in the first and the second valve chambers 47, 48 from the first and the second openings 54, 55, and flows in the first and the second distribution flow passages 66, 67 via the first and the second inlets 42, 43. A part of the fuel gas flowed in the second distribution flow passage 67 flows in the third valve chamber 49 from the connecting flow passage 57 via the third opening 56, and flows in the third distribution flow passage 68 from the third inlet 44. The fuel gas flowed in the first to the third distribution flow passages 66 to 68 rises along the first to the third introduction portions 35 to 37, diffuses to the first to the third distribution portions 38 to 40, and is supplied to the respective rich-lean burners from the nozzles 30.

Then, when the controller 9 operates the ignitor, and the discharge electrode 20 continuously discharges, an air-fuel mixture ejected from the flame hole portions of the respective rich-lean burners is combusted. The combustion exhaust gas of the burner unit is heat-exchanged with water passing through the heat transfer pipe of the heat exchanger 4, the water is turned into hot water at a set temperature, and the hot water is flowed out from the hot water outlet pipe 12.

The controller 9 adjusts the degree of opening of the proportional valve 17 corresponding to the required combustion amount to adjust the supply amount of the fuel gas from the gas proportional valve unit 16, and continuously changes the rotation speed of the air supply fan 8 to keep a predetermined air-fuel ratio.

The controller 9 controls the open and close of the first to the third solenoid valves 50 to 52 of the gas distribution unit 7 corresponding to the required combustion amount, thereby selecting the burner groups of the respective first to third distribution flow passages 66 to 68 control the number of the burners to be combusted in stages.

For example, when only the burner group in the center (four rich-lean burners) corresponding to the second distribution flow passage 67 is combusted, the controller 9 closes the first solenoid valve 50 and the third solenoid valve 52, and opens only the second solenoid valve 51. Therefore, the fuel gas flows in the second distribution flow passage 67 from the main flow passage 65 via the second valve chamber 48, and combusts the burner group in the center (one-stage combustion).

When the burner group in the center and the burner group in the right side (three rich-lean burners) are combusted, the controller 9 closes the first solenoid valve 50, and opens the second solenoid valve 51 and the third solenoid valve 52. Therefore, the fuel gas flows in the second distribution flow passage 67 from the main flow passage 65 via the second valve chamber 48, and flows in the third distribution flow passage 68 from the connecting flow passage 57 via the third opening 56 and the third valve chamber 49, thus combusting the burner groups in the center and the right side (seven rich-lean burners) (two-stage combustion).

Furthermore, when the burner group in the center and the burner group in the left side (thirteen rich-lean burners) are combusted, the controller 9 opens the first solenoid valve 50 and the second solenoid valve 51, and closes the third solenoid valve 52. Therefore, the fuel gas flows in the first and the second distribution flow passages 66, 67 from the main flow passage 65 via the first and the second valve chambers 47, 48, and combusts the burner groups in the center and the left side (seventeen rich-lean burners) (three-stage combustion).

Then, when all of the burner groups are combusted, the controller 9 opens the first to the third solenoid valves 50 to 52. Therefore, the fuel gas flows in the first and the second distribution flow passages 66, 67 from the main flow passage 65 via the first and the second valve chambers 47, 48, and flows in the third distribution flow passage 68 via the connecting flow passage 57 and the third valve chamber 49, thus combusting all of the burner groups (twenty rich-lean burners) (four-stage combustion).

Thus, the number of the burners to be combusted in the twenty rich-lean burners can be switched in four stages.

However, depending on the country, the region, or the like where the water heater 1 is used, three stages of seven, thirteen, and twenty rich-lean burners are sufficient in some cases instead of the configuration in which the number of the burners to be combusted is switchable in four stages.

Figure 8:
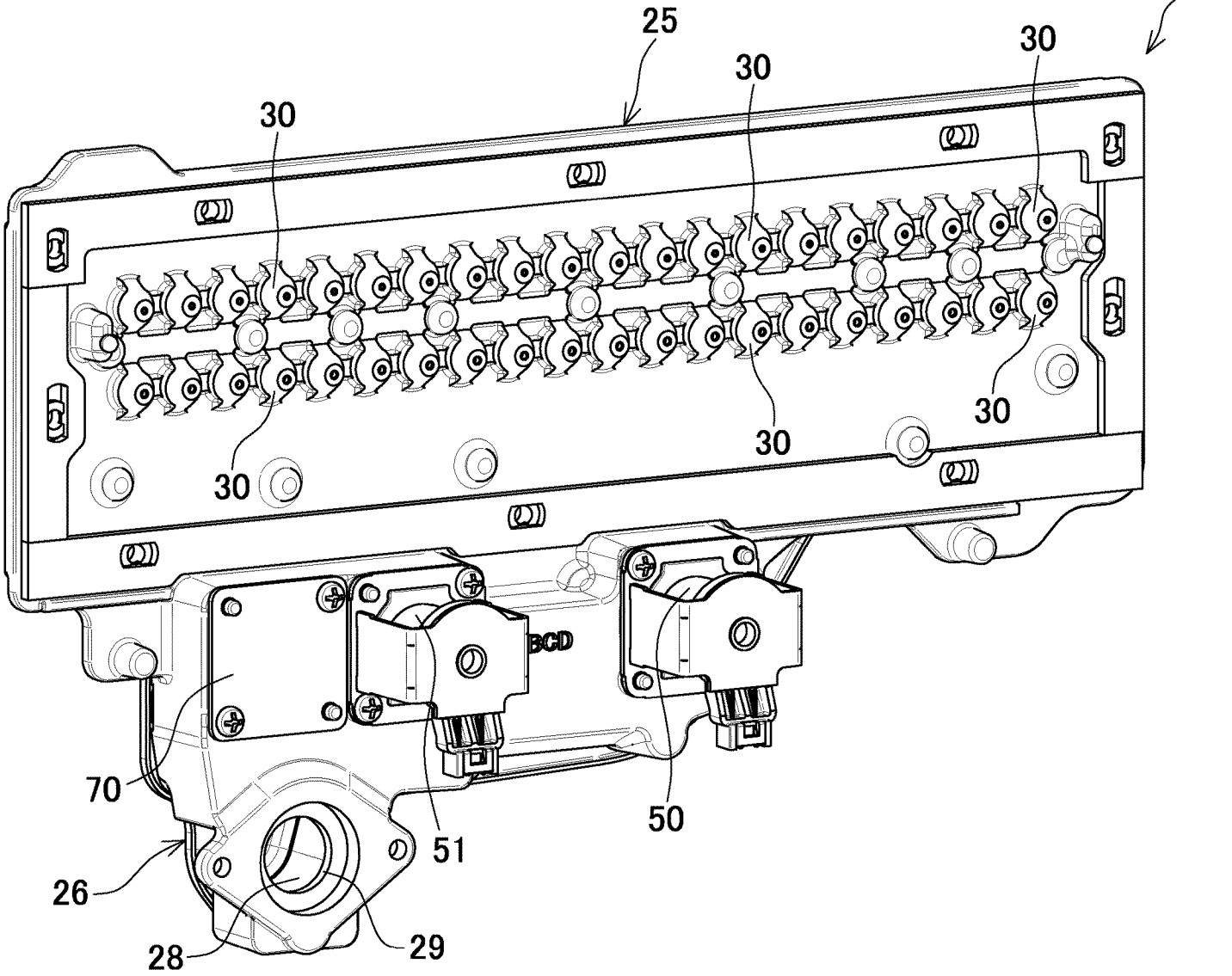
FIG. 8 is a perspective view of the gas distribution unit to which an obstruction plate is mounted instead of a third solenoid valve from the rear side.
Figure 9:
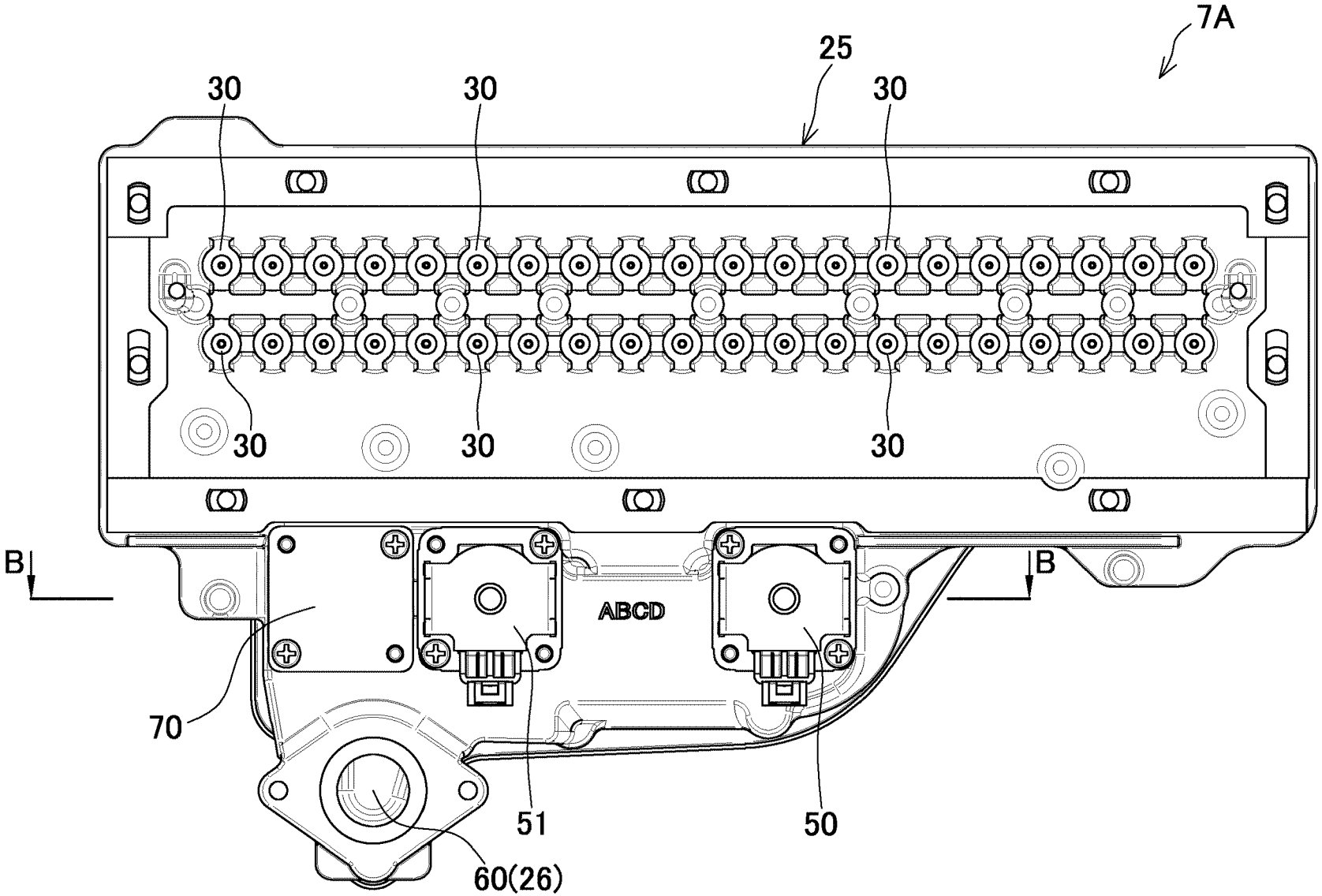
FIG. 9 is a back view of the gas distribution unit to which the obstruction plate is mounted instead of the third solenoid valve.
Figure 10:
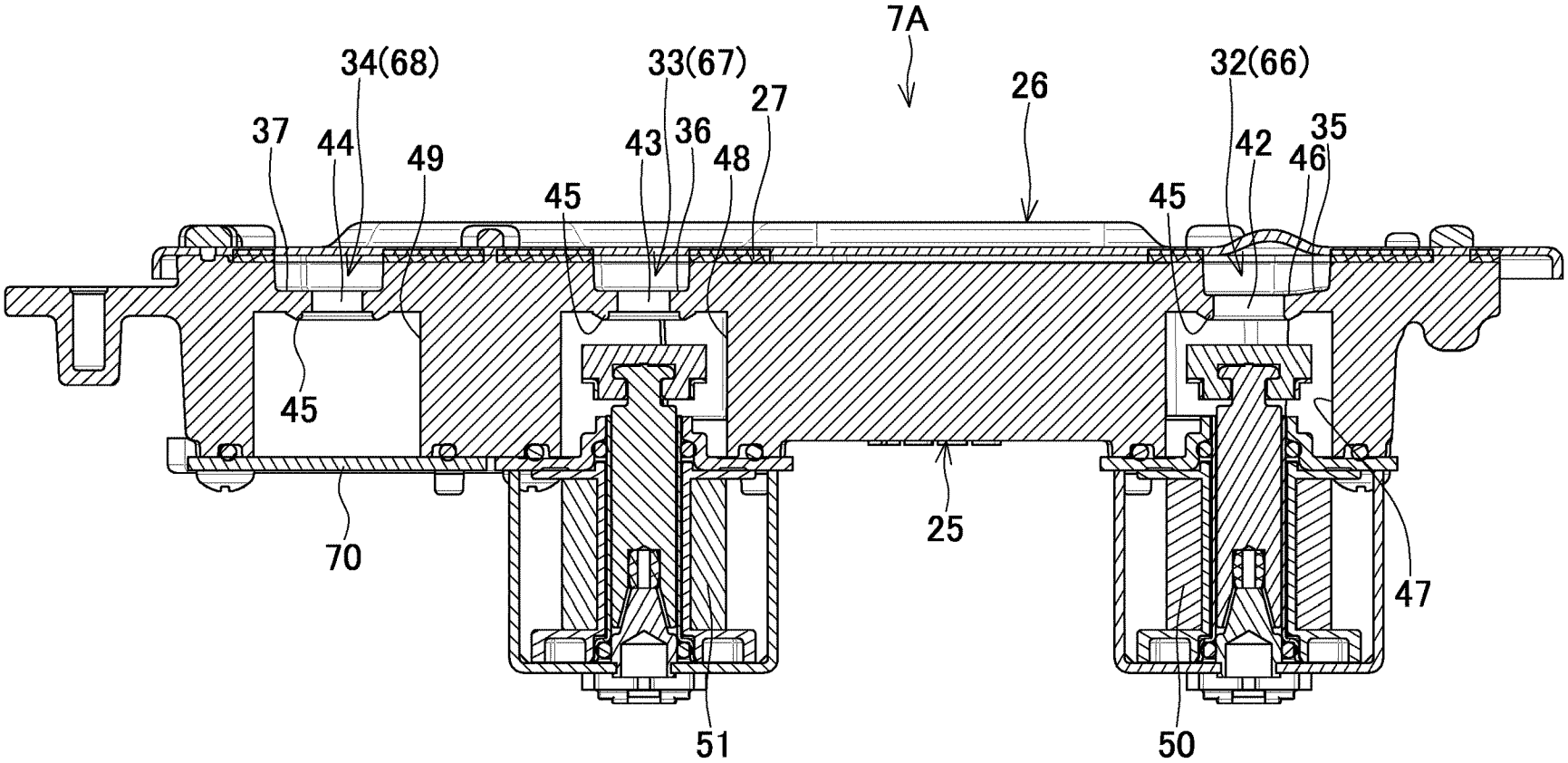
FIG. 10 is an enlarged cross-sectional view taken along the line B-B of FIG. 9.

In this case, as illustrated in FIG. 8 to FIG. 10, an obstruction plate 70 is screwed over the opening of the third valve chamber 49 instead of the third solenoid valve 52, thereby obstructing the opening of the third valve chamber 49. Accordingly, in a gas distribution unit 7A, for the third distribution flow passage 68 connected to the second distribution flow passage 67 via the connecting flow passage 57, whether to supply the fuel gas or not can be switched by opening and closing only the second solenoid valve 51.

Specifically, when the burner group in the center corresponding to the second distribution flow passage 67 and the burner group in the right side are combusted, the controller 9 closes the first solenoid valve 50 and opens the second solenoid valve 51. Therefore, the fuel gas flows in the second distribution flow passage 67 from the main flow passage 65 via the second valve chamber 48, and flows in the third distribution flow passage 68 via the connecting flow passage 57 and the third valve chamber 49, thus combusting the burner groups in the center and the right side (seven rich-lean burners) (one-stage combustion).

When the burner group in the left side is combusted, the controller 9 opens the first solenoid valve 50, and closes the second solenoid valve 51. Therefore, the fuel gas flows in the first distribution flow passage 66 from the main flow passage 65 via the first valve chamber 47, and combusts the burner group in the left side (thirteen rich-lean burners) (two-stage combustion).

Then, when all of the burner groups are combusted, the controller 9 opens the first and the second solenoid valves 50, 51. Therefore, the fuel gas flows in the first and the second distribution flow passages 66, 67 from the main flow passage 65 via the first and the second valve chambers 47, 48, and flows in the third distribution flow passage 68 via the connecting flow passage 57 and the third valve chamber 49, thus combusting all of the burner groups (twenty rich-lean burners) (three-stage combustion).

Thus, in the gas distribution unit 7A, the number of the burners to be combusted in the twenty rich-lean burners can be switched in the three stages, and simply replacing the third solenoid valve 52 with the obstruction plate 70 allows using the other components of the gas distribution unit 7 in common.

In the main body 25, since the thickness T1 in the center axis direction of the first inlet 42 having the large diameter is smaller than the thickness T2 in the center axis direction of the second and the third inlets 43, 44 having the small diameter, the pressure loss in the first distribution flow passage 66 can be reduced without making the diameter of the valve seat 45 of the first inlet 42 larger than the diameters of the valve seats 45 of the second and the third inlets 43, 44. Accordingly, the need for using a solenoid valve with a large valve element for only the first inlet 42 is eliminated. Additionally, the diameters of the second and the third inlets 43, 44 can be relatively increased relative to the diameter of the first inlet 42, thus leading to the reduction of the pressure loss at the maximum combustion. Accordingly, even when the supply pressure of the fuel gas is low, the required supply amount of the fuel gas can be ensured.

While it is considered that the thickness of the main body 25 is thinned to decrease the thickness of the first inlet 42, decreasing the thickness of the main body 25 causes a warp when a surface treatment by blast is performed, and assembling to the inner case 6 possibly fails. Accordingly, only the thickness of the first inlet 42 is partially decreased, and the main body 25 has the thickness necessary for ensuring the flatness with the inner case 6.

The following describes effects of the disclosure relating to the thickness in the center axis direction of the inlet having the large diameter.

In the water heater 1 configured as described above, the gas distribution unit 7 is assembled to the combustion device 3 that houses twenty rich-lean burners (example of three or more burners), and includes the main body 25 and the lid body 26. In the main body 25, twenty pairs of the nozzles 30 (example of three or more nozzles) that eject the fuel gas to the respective rich-lean burners are disposed side by side. The lid body 26 covers the main body 25.

The gas distribution unit 7 includes the main flow passage 65 to which the fuel gas is introduced, and the first to the third distribution flow passages 66 to 68 (example of a plurality of distribution flow passages) that branch the fuel gas from the main flow passage 65 and supplies the fuel gas to each of the groups of the plurality of nozzles 30 mutually different in number. The main body 25 includes: the main depressed portion 28 that forms the main flow passage 65; the first to the third depressed portions 32 to 34 (example of a plurality of depressed portions) that form the distribution flow passages 66 to 68, respectively; the first to the third inlets 42 to 44 (example of inlet) that are provided at the upstream ends of the depressed portions 32 to 34, respectively and communicated with the main depressed portion 28; and the first to the third solenoid valves 50 to 52 (example of a plurality of solenoid valves) that open and close the inlets 42 to 44, respectively.

Then, among the inlets 42 to 44, the first inlet 42 of the first depressed portion 32 corresponding to the group including the largest number of the nozzles 30 is formed to have the diameter larger than the diameters of the second and the third inlets 43, 44 of the other second and third depressed portions 33, 34. The first inlet 42 having the large diameter is formed to have the thickness T1 in the center axis direction smaller than those of the other second and third inlets 43, 44.

With the configuration, the pressure loss in the first distribution flow passage 66 can be reduced while using the first solenoid valve 50 the same in size as the second and the third solenoid valves 51, 52 of the second and the third distribution flow passages 67, 68, and the required supply amount can be ensured even when the supply pressure of the fuel gas is low. Accordingly, the reduction of the pressure loss in the first distribution flow passage 66 can be achieved while avoiding the cost increase due to the use of the large-sized solenoid valve.

In the first inlet 42, since the portion including the inlet 42 is formed as the tapered portion 46 (example of cone shape) having the inlet 42 as the deepest portion, the thickness T1 in the center axis direction is formed to be smaller than the thickness T2.

Accordingly, the thickness T1 in the center axis direction of the first inlet 42 can be decreased without thinning the thickness of the main body 25, and the flatness with respect to the inner case 6 can be kept while ensuring the thickness of the main body 25.

The following describes modifications of the disclosure relating to the thickness in the center axis direction of the inlet having the large diameter.

An area and a depth of the tapered portion disposed in the peripheral area of the first inlet can be changed as necessary. The tapered portion does not need to be a partially tapered portion, and the whole circumference of the first inlet may be the tapered portion. The thickness in the center axis direction of the first inlet can be decreased with the shape other than the tapered portion.

While the diameters of the second inlet and the third inlet are the same in the above-described configuration, the diameters of the second inlet and the third inlet may be mutually different diameters insofar as the diameters are smaller than the diameter of the first inlet.

The number of the distribution flow passages is not limited to three, and may be increased or decreased as necessary. Accordingly, the inlet having the small thickness disposed at the distribution flow passage with the largest number of the pairs of the nozzles is not limited to the first distribution flow passage in the above-described configuration.

In the disclosure relating to the thickness in the center axis direction of the inlet, the adjacent two distribution flow passages do not need to be connected by the connecting flow passage. The distribution flow passages may be each independent by providing the solenoid valve at the inlet.

Next, effects of the disclosure relating to the selective mounting of the additional solenoid valve will be described.

The combustion device 3 of the water heater 1 configured as described above-includes the inner case 6 and the gas distribution unit 7. The inner case 6 houses the twenty rich-lean burners (example of three or more burners). The gas distribution unit 7 is assembled to the inner case 6. The gas distribution unit 7 includes: twenty pairs of the nozzles 30 (example of three or more nozzles) that eject the fuel gas to the respective rich-lean burners; the main flow passage 65 to which the fuel gas is introduced; and the second distribution flow passage 67 and the third distribution flow passage 68 (example of two distribution flow passages) that branch the fuel gas from the main flow passage 65 into each of the groups of the plurality of nozzles 30 mutually different in the number of the nozzles 30. By switching whether to supply the fuel gas to each of the distribution flow passages 67, 68 or not, the number of the rich-lean burners to be combusted can be switched.

In the gas distribution unit 7, at the upstream end of the second distribution flow passage 67 (example of distribution flow passage with the large number of nozzles), the second inlet 43 (example of inflow port) into which the fuel gas can flow from the main flow passage 65 is formed, and the second solenoid valve 51 (example of solenoid valve) configured to open and close the second inlet 43 is disposed.

Meanwhile, the connecting flow passage 57 is formed such that the connecting flow passage 57 communicates between the downstream side with respect to the second inlet 43 of the second distribution flow passage 67 and the third inlet 44 (example of communication port) provided at the upstream end of the third distribution flow passage 68 (example of distribution flow passage with the small number of nozzles), and the third solenoid valve 52 (example of additional solenoid valve) configured to open and close the third inlet 44 can be selectively mounted at the upstream end of the third distribution flow passage 68.

In the case of the gas distribution unit 7 in which the third solenoid valve 52 is mounted, the state of supplying the fuel gas to only the second distribution flow passage 67 by opening the second solenoid valve 51 and closing the third solenoid valve 52 and the state of supplying the fuel gas to the second and the third distribution flow passages 67, 68 by opening the second solenoid valve 51 and opening the third solenoid valve 52 can be mutually switched.

In the case of the gas distribution unit 7A in which the third solenoid valve 52 is not mounted, the state of supplying the fuel gas to the second and the third distribution flow passages 67, 68 by opening the second solenoid valve 51, and the state of not supplying the fuel gas to the second or the third distribution flow passages 67, 68 by closing the second solenoid valve 51 can be mutually switched.

The configuration can deal with the difference of the number of combustion stages between multiple stages (four stages) and smaller number of stages (three stages) while the components of the gas distribution units 7, 7A other than the third solenoid valve 52 are substantially used in common. Accordingly, the management and manufacturing cost can be reduced.

The third valve chamber 49 (example of valve chamber), to which the third solenoid valve 52 can be mounted, communicated with the connecting flow passage 57 and the third inlet 44 is formed to open at the upstream end of the third distribution flow passage 68. When the third solenoid valve 52 is not mounted to the third valve chamber 49, mounting the obstruction plate 70 that obstructs the opening of the third valve chamber 49 allows switching between the state of supplying the fuel gas to the second and the third distribution flow passages 67, 68 and the state of not supplying the fuel gas to the second or the third distribution flow passages 67, 68.

Accordingly, the replacement between the third solenoid valve 52 and the obstruction plate 70 facilitates the switch between the gas distribution units 7, 7A.

The gas proportional valve unit 16 (example of gas supply passage) that supplies the fuel gas to the main flow passage 65 of the gas distribution unit 7 is provided with the main solenoid valve 18. The second solenoid valve 51 serves as both the solenoid valve in the downstream side of the two solenoid valves disposed in series corresponding to the second distribution flow passage 67 and the solenoid valve in the downstream side of the two solenoid valves disposed in series corresponding to the third distribution flow passage 68.

Accordingly, even when the third solenoid valve 52 is not mounted to the third distribution flow passage 68, the safety standard of the water heater 1 can be satisfied.

The following describes modifications of the disclosure relating to the selective mounting of the additional solenoid valve.

While the two distribution flow passages in the right side in the three distribution flow passages are connected by the connecting flow passage in the above-described configuration, the two distribution flow passages in the left side may be connected by the connecting flow passage. The connecting flow passage may be connected to the right and left inlets such that the right and the left are reversed in the upstream-downstream relation.

The number of the distribution flow passages is not limited to three, two distribution flow passages may be connected by the connecting flow passage, and four or more distribution flow passages may be disposed such that the two distribution flow passages adjacent in right and left are connected by the connecting flow passages.

The configurations of the connecting flow passage and the valve chamber can be changed as necessary. For example, the connecting flow passage is not limited to the configuration in which the connecting flow passage is provided to be depressed in the main body and obstructed by the lid body, and may be formed by providing the bulge portion also in the lid body.

In the above-described configuration, all the thicknesses in the center axis direction of the inlets of the respective depressed portions may be the same.

Next, modifications common to the disclosures will be described.

The number of the pairs of the nozzles is not limited to that of the above-described configuration, and may be increased or decreased as necessary. The burner need not be a rich-lean burner. Accordingly, the nozzles may be disposed side by side in a row in the right-left direction instead of the pair of upper and lower nozzles.

The configurations of the main flow passage and each distribution flow passage are not limited to the above-described configurations. For example, the main flow passage may be disposed so as to have the gas introduction port to be left-right reversed. The main flow passage may be a separate body assembled to the main body.

The configuration of the water heater is not limited to the above-described configuration. For example, the disclosures are each applicable to a type that include a secondary heat exchanger to recover a latent heat, a type that includes an exhaust cylinder projecting upward, and a type that includes a bath circuit and a heater circuit.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

The invention claimed is:

1. A combustion device comprising:

an inner case that houses three or more burners; and a gas distribution unit assembled to the inner case, the gas distribution unit including three or more nozzles, a main flow passage, and at least two distribution flow passages, the three or more nozzles ejecting a fuel gas to the respective burners, the fuel gas being introduced to the main flow passage, the at least two distribution flow passages branching the fuel gas from the main flow passage to each of groups of a plurality of the nozzles mutually different in number of the nozzles, wherein the number of the burners to be combusted is switchable by switching whether to supply the fuel gas or not to each of the distribution flow passages, in the gas distribution unit, at an upstream end of the distribution flow passage with a large number of the nozzles, an inflow port into which the fuel gas is allowed to flow from the main flow passage is formed, and a solenoid valve configured to open and close the inflow port is disposed, a connecting flow passage is formed such that the connecting flow passage communicates between a downstream side with respect to the inflow port of the distribution flow passage with the large number of the nozzles and a communication port provided at an upstream end of the distribution flow passage with a small number of the nozzles, an additional solenoid valve configured to open and close the communication port is selectively mountable at the upstream end of the distribution flow passage with the small number of the nozzles, when the additional solenoid valve is mounted, a state of supplying the fuel gas to only the distribution flow passage with the large number of the nozzles by opening the solenoid valve and closing the additional solenoid valve and a state of supplying the fuel gas to the two distribution flow passages by opening the solenoid valve and opening the additional solenoid valve are mutually switchable, and when the additional solenoid valve is not mounted, a state of supplying the fuel gas to the two distribution flow passages by opening the solenoid valve and a state of not supplying the fuel gas to the two distribution flow passages by closing the solenoid valve are mutually switchable.

2. The combustion device according to claim 1, wherein a valve chamber communicated with the connecting flow passage and the communication port is formed to open at the upstream end of the distribution flow passage with the small number of the nozzles, the additional solenoid valve is mountable to the valve chamber, and when the additional solenoid valve is not mounted to the valve chamber, mounting an obstruction plate that obstructs an opening of the valve chamber allows switching between the state of supplying the fuel gas to the two distribution flow passages and the state of not supplying the fuel gas to the two distribution flow passages.

3. The combustion device according to claim 2, wherein a gas supply passage that supplies the fuel gas to the main flow passage of the gas distribution unit is provided with a main solenoid valve, and the solenoid valve serves as both a solenoid valve in a downstream side of two solenoid valves disposed in series corresponding to the distribution flow passage with the large number of the nozzles and a solenoid valve in a downstream side of two solenoid valves disposed in series corresponding to the distribution flow passage with the small number of the nozzles.

4. A water heater comprising:

the combustion device according to claim 2; and a heat exchanger through which a combustion exhaust gas of the burners of the combustion device passes, wherein the water heater is configured to cause a hot water to flow out by a heat exchange between a water passing through the heat exchanger and the combustion exhaust gas of the burners.

5. The combustion device according to claim 1, wherein a gas supply passage that supplies the fuel gas to the main flow passage of the gas distribution unit is provided with a main solenoid valve, and the solenoid valve serves as both a solenoid valve in a downstream side of two solenoid valves disposed in series corresponding to the distribution flow passage with the large number of the nozzles and a solenoid valve in a downstream side of two solenoid valves disposed in series corresponding to the distribution flow passage with the small number of the nozzles.

6. A water heater comprising:

the combustion device according to claim 1; and a heat exchanger through which a combustion exhaust gas of the burners of the combustion device passes, wherein the water heater is configured to cause a hot water to flow out by a heat exchange between a water passing through the heat exchanger and the combustion exhaust gas of the burners.

* * * * *